US006938766B1

(12) United States Patent
Lee

(10) Patent No.: US 6,938,766 B1
(45) Date of Patent: Sep. 6, 2005

(54) FIBER HOLDER

(76) Inventor: Thomas M. Lee, P.O. Box 552, Millbury, MA (US) 01527

( * ) Notice: Subject to any disclaimer, the term of this patent is extended or adjusted under 35 U.S.C. 154(b) by 70 days.

(21) Appl. No.: 10/376,219

(22) Filed: Feb. 27, 2003

(51) Int. Cl.[7] ..... B07C 7/04; A47F 5/02
(52) U.S. Cl. ..... 206/388; 209/704; 211/163
(58) Field of Search ..... 206/349, 371, 206/372, 373, 388, 553; 211/10, 41.1, 70.6, 211/70.8, 70, 131.1, 163; 209/704

(56) References Cited

U.S. PATENT DOCUMENTS

| | | | | | |
|---|---|---|---|---|---|
| 160,339 | A | * | 3/1875 | Ladd | 211/62 |
| 228,998 | A | * | 6/1880 | Johnston | 211/70 |
| 305,498 | A | * | 9/1884 | Barker | 248/37.3 |
| 978,670 | A | * | 12/1910 | Solomon | 211/163 |
| 1,221,517 | A | * | 4/1917 | Dunbar | 211/70 |
| 1,327,581 | A | * | 1/1920 | Yeats | 223/106 |
| 1,759,140 | A | * | 5/1930 | Silberger | 211/77 |
| 2,371,433 | A | * | 3/1945 | Davis | 211/70.6 |
| 3,034,195 | A | * | 5/1962 | LeClabart | 206/388 |
| 3,104,778 | A | | 9/1963 | Leonard | |
| 3,702,508 | A | | 11/1972 | Hetter | |
| 4,380,296 | A | | 4/1983 | Murray et al. | |
| 5,379,885 | A | * | 1/1995 | Chen | 206/216 |
| 6,360,891 | B1 | * | 3/2002 | Rideout | 206/373 |

* cited by examiner

*Primary Examiner*—John A. Ricci
(74) *Attorney, Agent, or Firm*—Blodgett & Blodgett, P.C.

(57) ABSTRACT

The invention is a suspension plate system for providing access to hanks of fiber. The system may include a circular, transparent, plastic disc having a plurality of truncated conic circular bores located equidistant from the center of the disc and being substantially equidistant from each other. Each bore has a larger diameter opening on the top of the disc and a smaller diameter opening on the bottom of the disc. A plurality of generally radial slots equal in number to the number of bores are located on the disc to communicate between each bore and the outer edge of the disc. Each bore provides a device wherein a hank of fiber, cut into substantially equal lengths to other hanks and divided by color and/or nature can be presented for display and use. The hank of fiber of like color and/or nature is bound by a knob-like binder that can be captured in one of the bores, with the hank of fiber suspended down from the disc, thus locking the hank of fiber in place relative to other hanks and to the disc. The binder is captured because its effective diameter is between the diameters of the upper and lower openings of the bore. The slot allows the hank of fiber to be axially placed within the bore without the hank having to be threaded longitudinally into the bore.

3 Claims, 9 Drawing Sheets

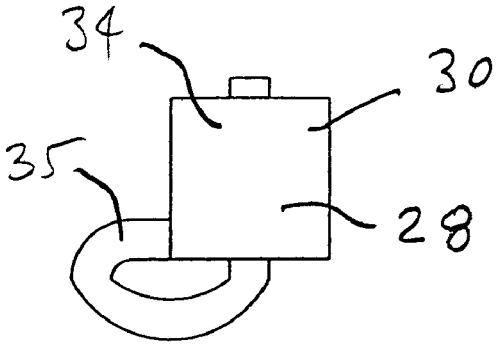
FIG. 10
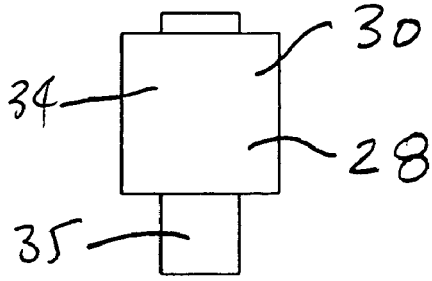
FIG. 11
FIG. 12
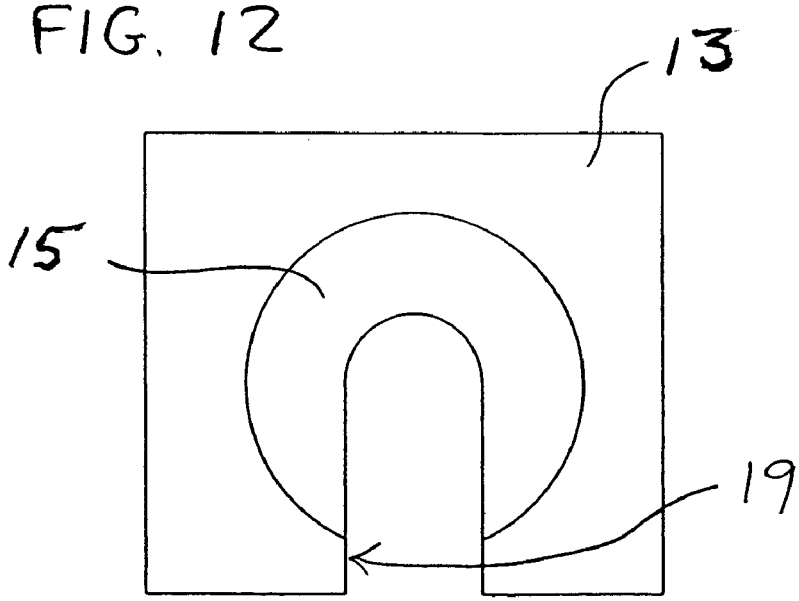

FIBER HOLDER

CROSS-REFERENCE TO RELATED APPLICATIONS

Not Applicable.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

1. Field of the Invention

The invention relates to a fiber holder, and particularly a fiber holder for securing and presenting hanks of fiber which have been separated by color and/or nature.

2. Prior Art

Various devices have been provided in the past for holding hanks of fiber wherein the fiber may be separated by colors and/or nature and displayed for selection and use. Because of the physical nature of the hanks of fiber, prior art devices had great difficulty securing the hanks reliably but also removably to the devices. Furthermore, the prior art devices did not present the fiber to the user in the easiest and most convenient manner.

This invention particularly concerns the field of fly tying and more specifically to a device for storing and presenting fly-tying material in the most effective way to the fly tyer.

One of the most challenging and creative activities relating to the sport and hobby of fishing is the creation of decorated fish hooks generally called flies. The art and craft of constructing these flies not only requires tremendous skill and patience, but also requires extensive knowledge not only of fish psychology, but also of the history of fly tying which dates back hundreds of years and provides a great deal of practical knowledge about the kinds of things that are attractive to fish. Part of the challenge of fly tying is the vast array of raw materials which are used for that activity. One particular kind of raw material involves strands of fiber which are usually used in bunches or hanks and are generically called floss. The floss can be made from a wide variety of materials both natural and synthetic and can come in a wide range of colors, forms, flexibility, reflectivity, transparency, and numerous other physical and optical characteristics. It is very desirable to allow the bundles of floss to be stored in the manner which allows for neat and orderly storage, but which also allows for keeping and presenting the stored floss to the fly tyer so that the fly tyer can access floss in a simple and efficient way to allow efficient manufacturing of the flies. In addition to storing and presenting the floss in very effective manner, is very important that the floss be provided in bundles of parallel fiber which can easily be clipped with scissors to provide the length and number of fibers desired by the fly tyer for a particular operation.

When the various colors and types of floss are stored in a random manner as such as in a box or other container, they tend to become mixed together become hard to find and become quite difficult to gather into the effective parallel bundles which are usually necessary to carry out the fly tying operation. Over the years, numerous techniques and equipment have been developed to try to bring some order to the fly tying storage function. However in most cases, the storage systems which hold the floss in an orderly fashion are difficult to reach and difficult to identify and access the desired floss. In other cases, the floss cannot easily be grabbed by the fly tyer so that the fly tyer can select a bundle of fibers of floss that are of the correct number and then clip off the correct length in an easy and efficient operation. These difficulties experienced with a prior art devices have been obviated in a novel manner by the present invention.

OBJECTS AND SUMMARY OF THE INVENTION

It is an object of the instant invention to provide a fiber holder which easily maintains the fiber in predetermined locations and divided from other fiber in the group.

Another object is to provide a fiber holder which can be easily manipulated to provide access to the desired fiber of a given color, nature, and of a preselected length.

Still another object is to enable the user to pull out individual threads of fiber without entangling or jamming either the hank or interfering with the other hanks of fiber.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

The invention comprises a suspension plate such as a circular, transparent, plastic disc having a plurality of truncated conic circular bores located equidistant from the center of the disc and being substantially equidistant from each other. The plate could be wood or other material. Each bore has a larger diameter opening on the top of the disc and a smaller diameter opening on the bottom of the disc. A plurality of generally radial slots equal in number to the number of bores are located on the disc to communicate between each bore and the outer edge of the disc. Each bore provides a device wherein a hank of fiber, cut into substantially equal lengths to other hanks and divided by color and/or nature can be presented for display and use. The hank of fiber of like color and/or nature is bound by a knob-like binder that can be captured in one of the bores, with the hank of fiber suspended down from the disc, thus locking the hank of fiber in place relative to other hanks and to the disc. The binder is captured because its effective diameter is between the diameters of the upper and lower openings of the bore. The slot allows the hank of fiber to be axially placed within the bore without the hank having to be threaded longitudinally into the bore. The disc can be rotatably mounted, by means of a support, to a base. The base can sit on a surface or can be attached to a surface. Because the disc is rotatably mounted, it has carousel or "Lazy-Susan" functionality, to facilitate user access to the hanks of fiber.

BRIEF DESCRIPTION OF THE DRAWINGS

The above and other objects of the invention will become more readily apparent from the following description and accompanying drawings wherein:

FIG. 10 is a front elevation view of a closed wire tie used as a binder in one embodiment of the present invention;

FIG. 11 is a right side front elevation view of the closed wire tie shown in FIG. 10 and used as a binder in one embodiment of the present invention;

FIG. 12 is a diagrammatic plan view of a conic bore and slot embodying the principles of the present invention;

DETAILED DESCRIPTION OF THE INVENTION

Figure 1:
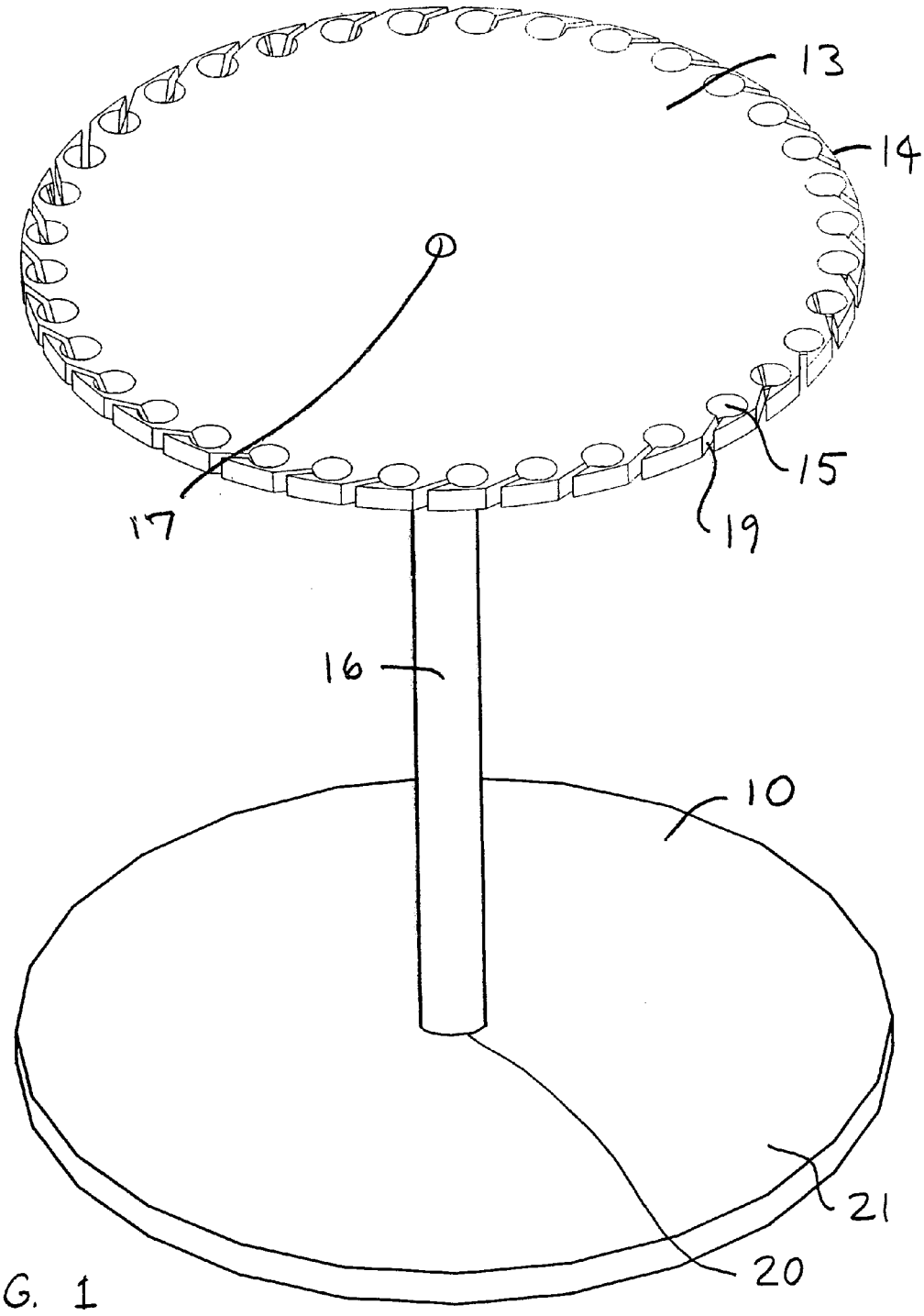
FIG. 1 is a perspective view of one embodiment of the invention.

A fiber holder is seen as element 10 in FIG. 1 and includes a plate which may be a generally planar, transparent, plastic disc 13 and which has a plurality of circular bores or holes 15 located substantially equidistant from the center of the disc 13. The disk could also be made of wood or other material. On substantially the same radius as the holes 15 are a corresponding number of generally radially extending grooves or slots 19 each of which communicates between a bore 15 and the outer edge 14 of the disc 13. The grooves may be radial or may be at an angle to the radius.

Attached to the disc 13 is a plastic or other type support 16 which are secured by means of a fastening system 17. The support 16 is secured by means of a fastening system 20 to a base 21 which contacts a support surface such as a table surface or a wall. The disc 13 rotates in a "lazy-Susan" manner with respect to the surface, and typically rotates in a "lazy-Susan" manner with respect to the base 21.

In the preferred embodiment, each of the bores 15 is formed so that the upper opening at the upper surface of the disc has a greater effective diameter than the effective diameter of the lower opening at the lower surface of the disc. As a result, an object, namely a binder 28, that has an effective diameter between the effective diameter of the upper opening and the effective diameter of the lower opening will enter the upper opening, but will not pass through the lower opening or the bore 15. As a result, the binder would be trapped in the bore. Although this trapping action is preferred, some of the benefits of this invention can be achieved by any geometry in which binder cannot pass through the bore.

As used in this context, the concept of effective diameter seeks to compensate for the pass-through quality of an opening and an object that may have different shapes and cross-sections. An object has an effective diameter that is smaller than the effective diameter of an opening if the object will pass through the opening. Conversely, an object has an effective diameter that is greater than the effective diameter of an opening if the object will not pass through the opening.

This becomes significant when the object and the opening have different shapes, for example, when the object is cubic and the opening is round.

Each of the generally radially extending grooves or slots 19 communicates between a bore 15 and the outer edge 14 of the disc 13. The grooves 19 may be radial or may be at an angle to the radius. The walls of the slots are generally parallel to the axis of the disc. The walls of each of the slots are generally parallel to each other, but can diverge, especially as the slot approaches the outer edge of the disc. This creates a funnel effect as fiber 25 is passed from outside the disc, into the slot as will be discussed below. The distance between the walls of each slot at the inner of bore end of the slot is generally less or equal to that the effective diameter to the lower opening of the bore, so that the binder cannot pass through the slot. Only the hank 32 of fiber can pass through the slot.

A plurality of strands of fiber 25 are cut of substantially equal lengths to form a hank 32. The hank 32 is fastened by encircling the hank 32 with a binder 28. The binder has an effective diameter substantially greater then the diameter to the hank. Preferably, the binder 28 is a plastic wire tie 30. Typically, a wire tie 30 is an elongated nylon strap with a serrated texture along its length and a bulbous lock at one end. The lock contains a one way rachet so that, when the strap is threaded through the lock, the ratchet engages that serrated texture so that the strap cannot be withdrawn. Although the binder 28 is preferably a wire tie 30, it could be any other type of encircling and enlarged element including an encircling tape or strap, or a knot in the hank.

To install a hank 32 of fiber 25 on the fiber holder 10, the hank 32 is held with the binder 28 up and the fiber 25 hanging down. The hank 32 is positioned outside of the disc 13 with the binder 28 above the plane of the upper surface of the disc and the fiber hanging down to a point below the plane of the lower surface of the disc 13. The fibers 25 of the hank 32 are compressed inwardly to minimize the diameter of the hang and the hank 32 is moved inwardly into a slot. The hanging hank 32 moves in and along the slot 19 with the binder 28 above the disc 13. Once the binder 28 is above the bore 15 associated with the slot 19, the hank 32 is pulled down and the binder 28 is pulled into and trapped in the bore 15. The hanging hank 32 then expands, locking the binder 28 in the bore 15.

In operation, a hank 32 of fiber 25 is locked into each bore 15, with each hank 32 being of a different color and/or nature. The fly tyer can rotate the disc 13 until a desired hank 32 faces the tyer. The tyer can then grab and cut-off the desired geometry of fiber 25 for use in the tying operation. When the hank 32 is depleted, it can be removed and replaced.

Figure 2:
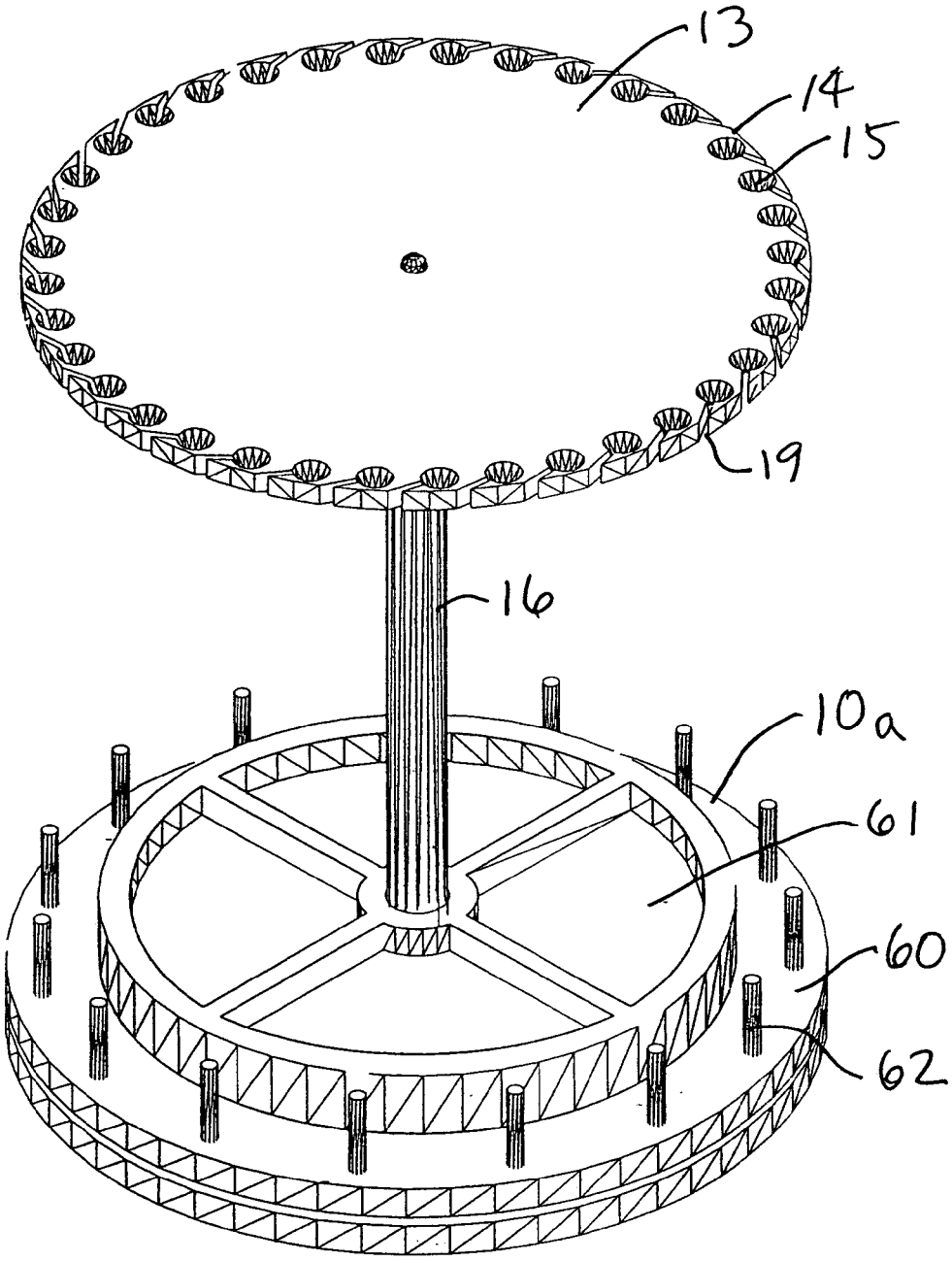
FIG. 2 is a perspective view of a second embodiment of the invention, including a lower plate with depressions for holding small items, and vertical pins for holding spools of thread.
Figure 3:
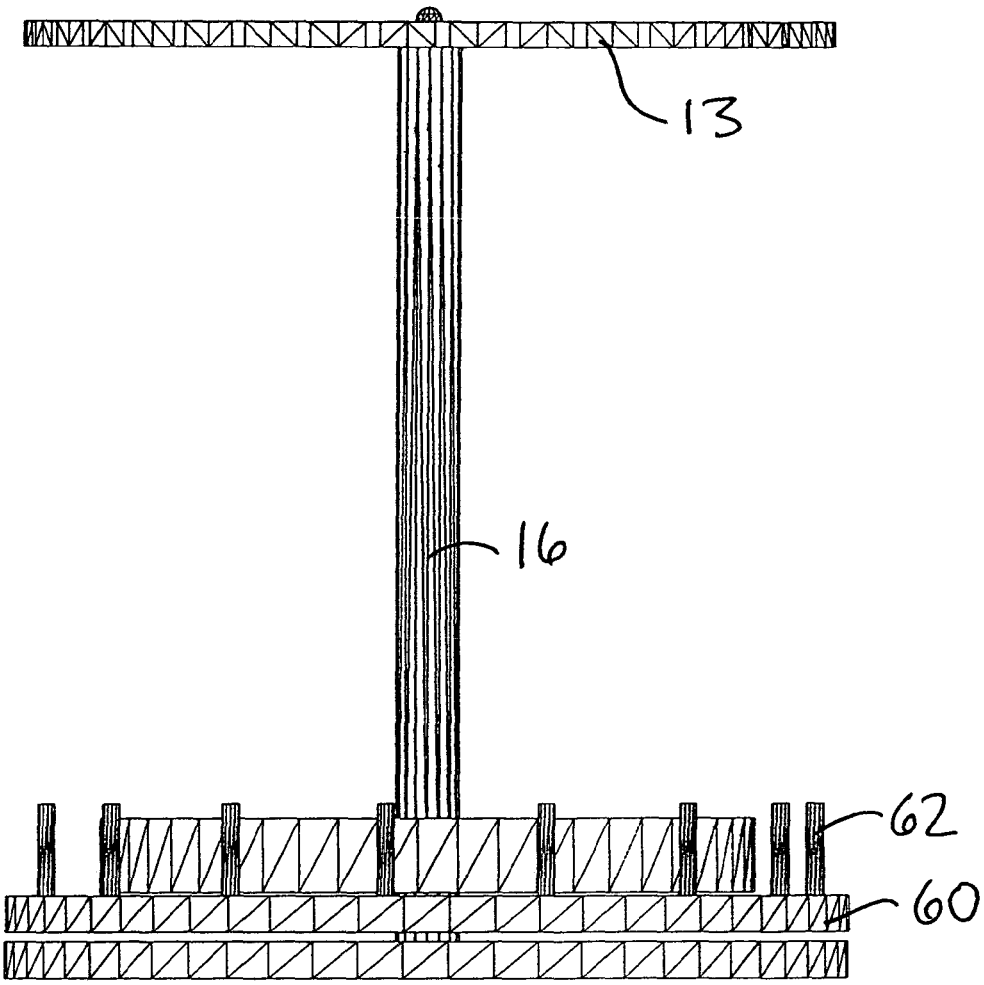
FIG. 3 is a front elevation view of the second embodiment of the invention, which is shown in FIG. 2.

FIG. 2 is a perspective view of a second embodiment of the invention, including a lower plate 60 with depressions 61 for holding small items, and vertical pins 62 for holding spools of thread. FIG. 3 is a front elevation view of the second embodiment of the invention, which is shown in FIG. 2.

Figure 4:
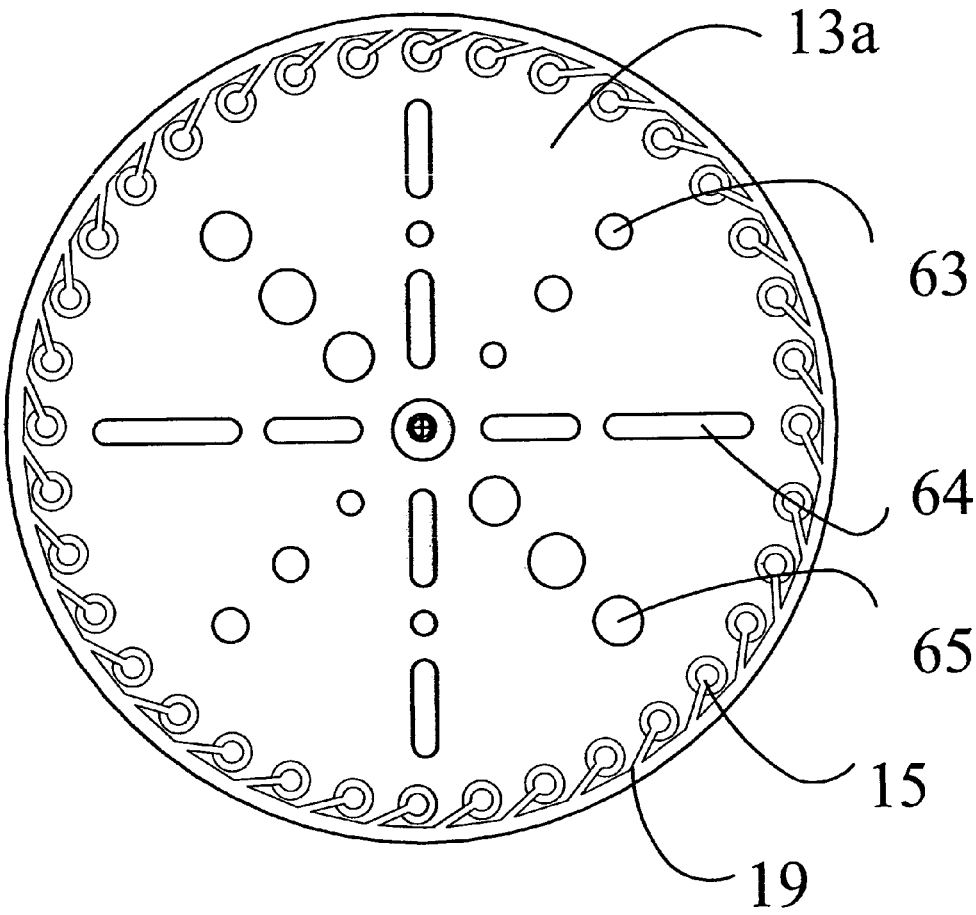
FIG. 4 is a plan view of a third embodiment of the invention, including openings in the upper plate for holding tools and equipment.

FIG. 4 is a plan view of a third embodiment of the invention, including openings 63, 64, and 65 cut through the upper plate 13*a* for holding tools and equipment.

Figure 5:
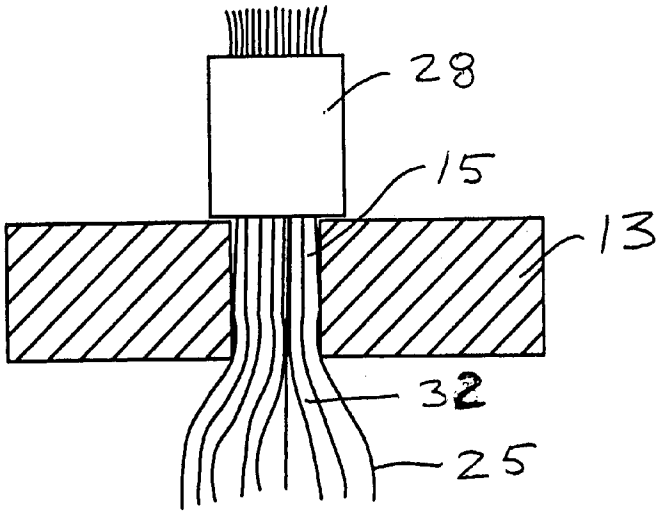
FIG. 5 is a diagrammatic front elevation view, in section, showing the holding action of a cylindrical bore, a binder, and a hank of fiber.

FIG. 5 is a diagrammatic front elevation view, in section, showing the holding action of a cylindrical bore 15 in the plate 13, a binder 28, and a hank 32 of fiber 25.

Figure 6:
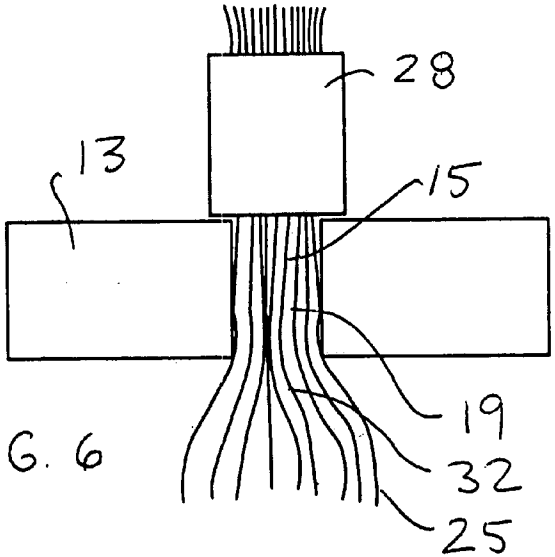
FIG. 6 is a diagrammatic front elevation view, not in section, of FIG. 5, showing the holding action of the cylindrical bore, the binder, and the hank of fiber, as seen looking radially into the slot.

FIG. 6 is a diagrammatic front elevation view, not in section, of FIG. 5, showing the holding action of the cylindrical bore 15 in the plate 13, the binder 28, and the hank 32 of fiber 25, as seen looking radially into the slot 19.

Figure 7:
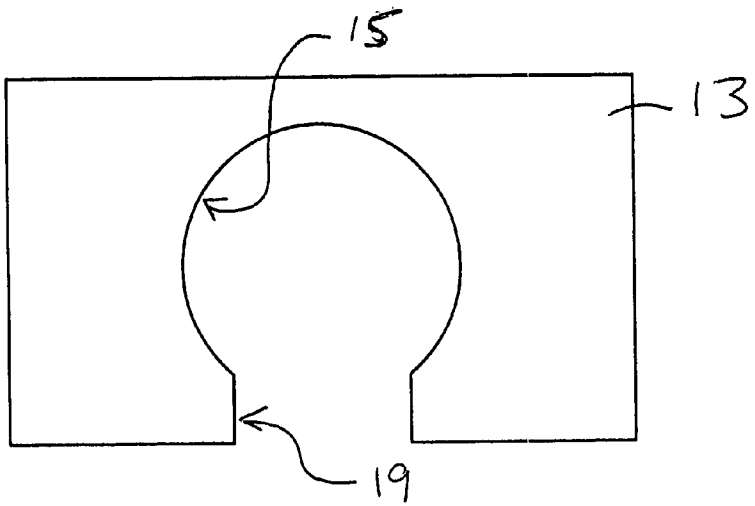
FIG. 7 is a diagrammatic plan view of the plate shown in FIGS. 5 and 6, showing the relationship between the cylindrical bore and the slot.

FIG. 7 is a diagrammatic plan view of the plate 13 shown in FIGS. 5 and 6, showing the relationship between the cylindrical bore 15 in the plate 13, and the slot 19. Because the width of the slot 19 is less than the diameter to the bore 15, the natural expansion of the hank 32 locks the hank 32 in the bore 15.

Figure 8:
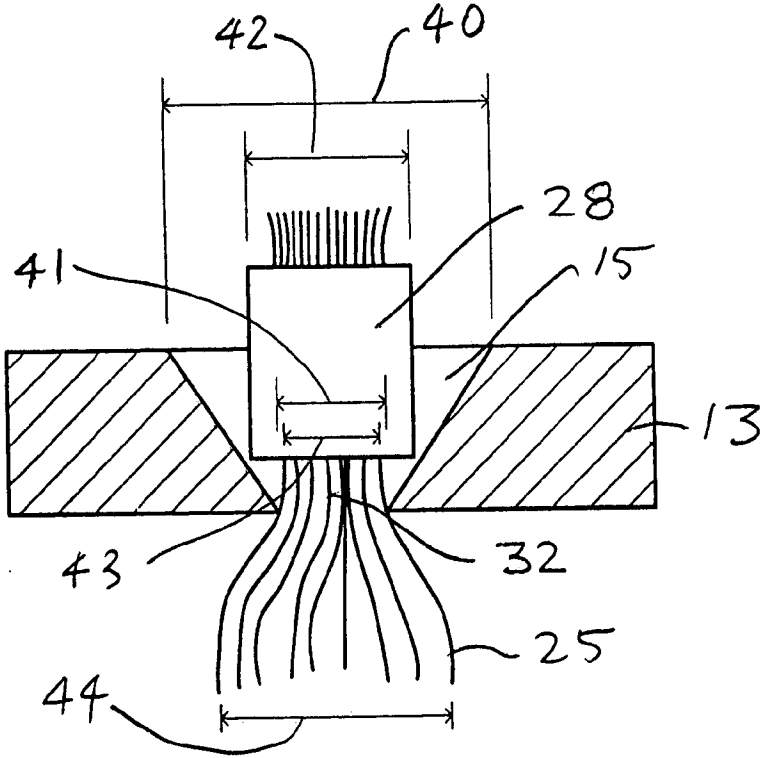
FIG. 8 is a diagrammatic front elevation view, in section, showing the trapping action of a conic bore, a binder, and a hank of fiber.

FIG. 8 is a diagrammatic front elevation view, in section, showing the trapping action of a conic bore 15 in the plate 13, a binder 28, and a hank 32 of fiber 25. The bore 15 has an upper opening with an upper effective diameter 40 and a lower opening with a lower effective diameter 41. The upper effective diameter 40 is greater than the lower effective diameter 41. The binder 28 has an effective diameter 42 which is between the upper effective diameter 40 and the lower effective diameter 41. When the hank 32 is compressed, it has an effective diameter 43, which is less that the width 45 of the slot 19, see FIG. 9, so that the hank 32 can pass through the slot 19. When the hank 32 uncompressed, it has an effective diameter 44, which is greater than the effective diameter 41 of the lower opening, so the action of the uncompressed hank 32 pulls the binder 28 into the bore 15.

Figure 9:
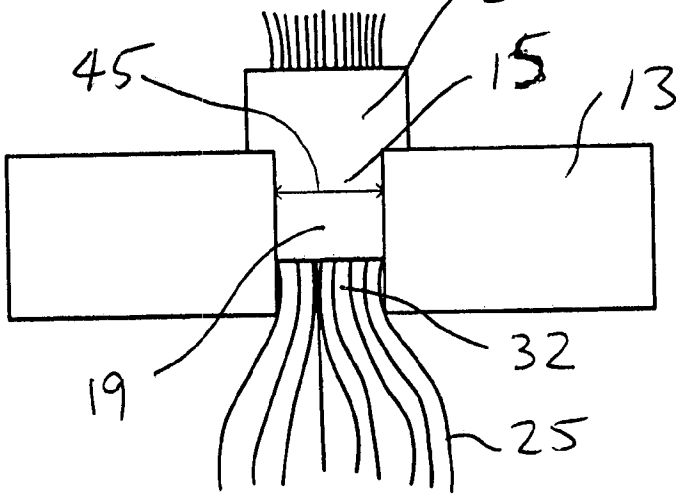
FIG. 9 is a diagrammatic front elevation view, not in section, of FIG. 8, showing the trapping action of the conic bore, the binder, and the hank of fiber, as seen looking radially into the slot.

FIG. 9 is a diagrammatic front elevation view, not in section, of FIG. 8, showing the trapping action of the conic bore 15 in the plate 13, the binder 28, and the hank 32 of fiber 25, as seen looking radially into the slot 19. It can be seen that the binder 28, which is in the bore, is too big to exit the slot 19.

FIG. 10 is a front elevation view of a closed wire tie 30 used as a binder 28 in one embodiment of the present invention. The wire tie includes an block-like locking element 34 and a wrapping element 35, which can be wrapped around a hank of fiber.

FIG. 11 is a right side front elevation view of the closed wire tie 30 shown in FIG. 10 and used as a binder 28 in one embodiment of the present invention. The wire tie includes an block-like locking element 34 and a wrapping element 35, which can be wrapped around a hank of fiber.

FIG. 12 is a diagrammatic plan view of a plate 13, a conic bore 15, and slot 19 in plate 13, embodying the principles of the present invention.

Figure 13:
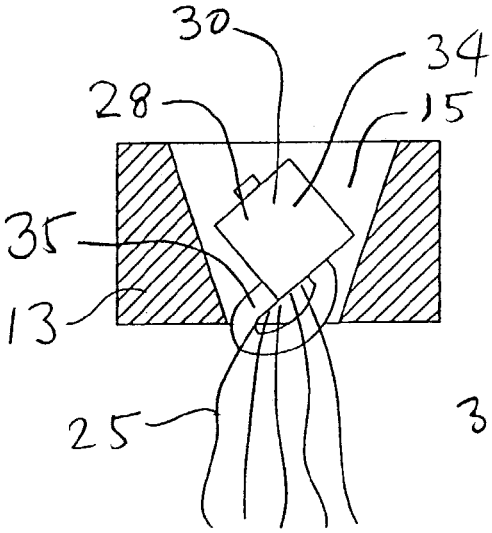
FIG. 13 is a front elevation view of a closed wire tie used as a binder in one embodiment of the present invention, showing the binder trapped in a diagrammatic sectioned conic bore with fiber hanging from the wire tie.

FIG. 13 is a front elevation view of a closed wire tie 30 used as a binder 28 in one embodiment of the present invention, showing the binder 28 trapped in a diagrammatic sectioned conic bore 15 with fiber 25 hanging from the wire tie 30.

Figure 14:
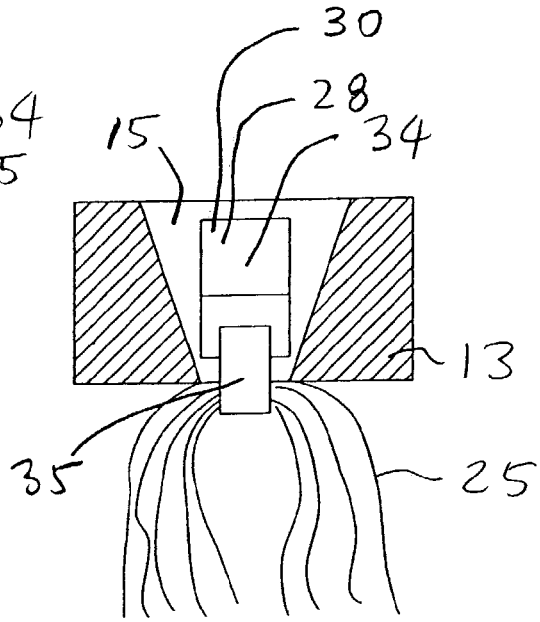
FIG. 14 is a right side elevation view of a closed wire tie used as a binder in one embodiment of the present invention, showing the binder trapped in a diagrammatic sectioned conic bore with fiber hanging from the wire tie.

FIG. 14 is a right side elevation view of a closed wire tie 30 used as a binder 28 in one embodiment of the present invention, showing the binder 28 trapped in a diagrammatic sectioned conic bore 15 with fiber 25 hanging from the wire tie 30.

Figure 15:
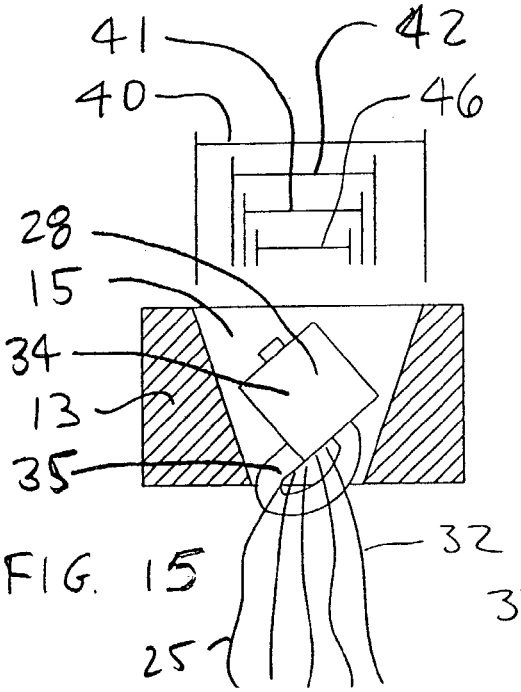
FIG. 15 is a front elevation view of a closed wire tie used as a binder in one embodiment of the present invention, showing the binder trapped in a diagrammatic sectioned conic bore with fiber hanging from the wire tie, as shown in FIG. 13, but with dimension lines to show the relative dimensions.

FIG. 15 is a front elevation view of a closed wire tie 30 used as a binder 28 in one embodiment of the present invention, showing the binder 28 trapped in a diagrammatic sectioned conic bore 15 with fiber 25 hanging from the wire tie 30, as shown in FIG. 13, but with dimension lines to show the relative dimensions. The bore 15 has an upper opening with an upper effective diameter 40 and a lower opening with a lower effective diameter 41. The upper effective diameter 40 is greater than the lower effective diameter 41. The binder 28 and more specifically, the locking element 34, has an effective diameter 42 which is between the upper effective diameter 40 and the lower effective diameter 41, the locking element 34 can pass down into the bore 15, but cannot pass through the bottom of the bore 15. The wrapping element 35 has an effective diameter 46 which is smaller than the lower effective diameter 41, so the wrapping element 35 can pass through the bottom of the bore 15, where it holds the hank 32 of fiber 25. When the hank 32 uncompressed, it has an effective diameter 44, which is greater than the effective diameter 41 of the lower opening, so the action of the uncompressed hank 32 pulls the binder 28 into the bore 15.

Figure 16:
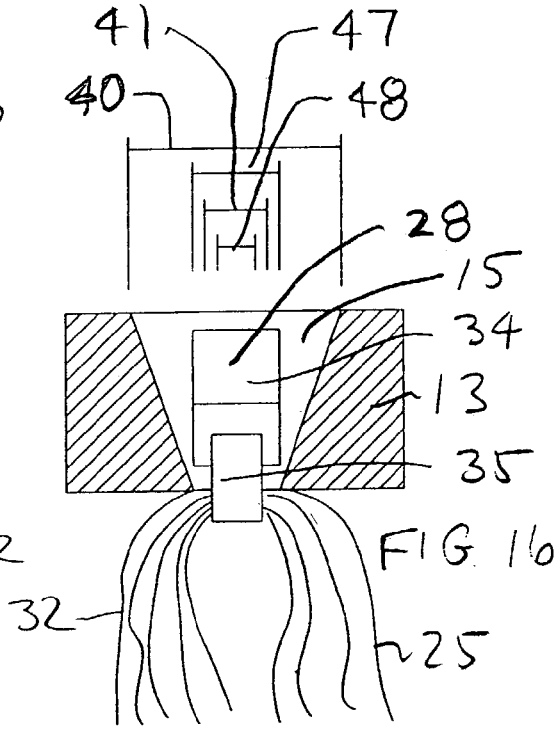
FIG. 16 is a right side elevation view of a closed wire tie used as a binder in one embodiment of the present invention, showing the binder trapped in a diagrammatic sectioned conic bore with fiber hanging from the wire tie, as shown in FIG. 14, but with dimension lines to show the relative dimensions.

FIG. 16 is a right side elevation view of a closed wire tie 30 used as a binder 28 in one embodiment of the present invention, showing the binder 28 trapped in a diagrammatic sectioned conic bore 15 with fiber 25 hanging from the wire tie 30, as shown in FIG. 14, but with dimension lines to show the relative dimensions. The bore 15 has an upper opening with an upper effective diameter 40 and a lower opening with a lower effective diameter 41. The upper effective diameter 40 is greater than the lower effective diameter 41. The binder 28 and more specifically, the locking element 34, has an minor diameter 47 which may be less than upper effective diameter 40 and the lower effective diameter 41, but it does not effect whether the locking element 34 can pass through the bottom of the bore 15. The larger effective diameter 42 determines that. The wrapping element 35 has a minor diameter 48. When the hank 32 uncompressed, it has an effective diameter 44, which is greater than the effective diameter 41 of the lower opening, so the action of the uncompressed hank 32 pulls the binder 28 into the bore 15.

Figure 17:
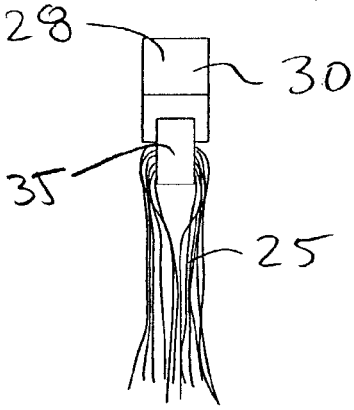
FIG. 17 is a right side and bottom view of the closed wire tie shown in FIG. 11 and used as a binder in one embodiment of the present invention, also showing the fiber bound in the wire tie.

FIG. 17 is a right side and bottom view of the closed wire tie 30 shown in FIG. 11 and used as a binder 28 in one embodiment of the present invention, also showing the fiber 25, in compressed form, bound in the wrapping element 35 of the wire tie 30.

Figure 18:
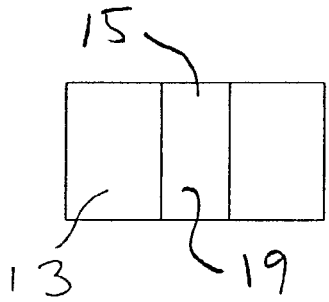
FIG. 18 is a diagrammatic front elevation view of the plate and bore, as seen looking radially into the slot.

FIG. 18 is a diagrammatic front elevation view of the plate 13 and bore 15, as seen looking radially into the slot 19.

Figure 19:
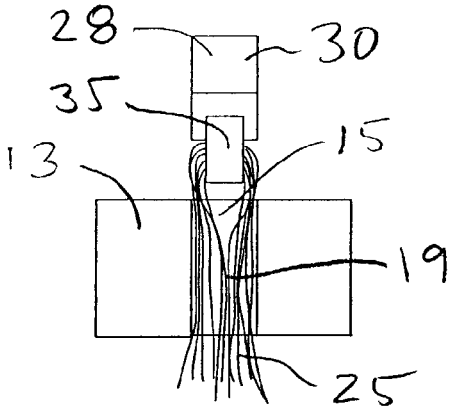
FIG. 19 is a diagrammatic front elevation view of the plate and bore, as seen looking radially into the slot; and showing the manner in which the bound fiber is compressed and passed into the slot, with the binder above the plate.

FIG. 19 is a diagrammatic front elevation view of the plate 13 and bore 15, as seen looking radially into the slot 19; and showing the manner in which the bound fiber 25 is compressed and passed into the slot 19, with the binder 28 above the plate.

Figure 20:
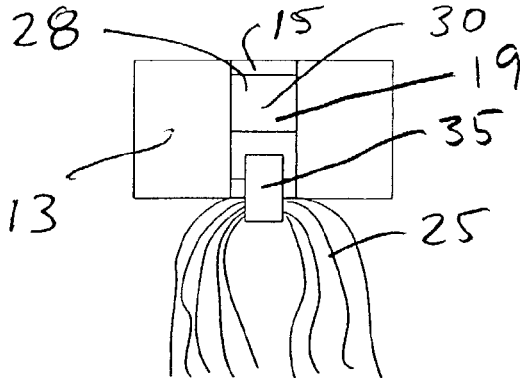
FIG. 20 is a diagrammatic front elevation view of the plate and bore, as seen looking radially into the slot; and showing the manner in which binder is drawn into and trapped in the bore, and the formerly compressed bound fiber is allowed to expand and hold the binder in the bore.

FIG. 20 is a diagrammatic front elevation view of the plate 13 and bore 15, as seen looking radially into the slot 19; and showing the manner in which binder 28 is drawn into and trapped in the bore 15, and the formerly compressed bound fiber 25 is allowed to expand and draw and hold the binder 28 in the bore 15.

On of the most important aspects of the preferred embodiment of this invention is the manner in which the hanks of fiber 25, which are bound by binders 28, are connected to the suspension plate for display and for use.

In the simplest form of this invention, each hank 32 of fiber 25 is bound by a cylindrical binder 28 at one end of the hank. In the preferred embodiment of the invention, the binder 28, which is preferably a wire tie 30, binds the hank 32 of fiber 25 at the center of the hank 32 so that a bundle of fiber 25 extends to each side of the binder 28.

The suspension plate 13 is provided with at least one bore 15 which passes through the plate. The upper end of the bore 15 has a first effective diameter and the lower end of the bore 15 has a second effective diameter. In the preferred embodiment, the bore would have a truncated conic shape with the larger diameter opening on the top of the plate and the smaller diameter opening on the bottom of the plate. A slot 19 is provided in and through the plate having a width approximately equal to the second diameter of the bore 15. The slot 19 provides access between the bore in the outer periphery 14 and outside of the plate 13.

In the simplest version of the invention, the binder 28 has an effective diameter which is smaller than the first diameter of the bore 15 but larger than the second or low diameter of the bore 15. This means that the binder 28 can be moved down into the bore, but will not pass through the bore. In practice, the binder with the hank 32 of fiber 25 hanging from the binder 28 will be moved radially inward from the outside of the plate 13 toward the bore 15. The binder 28 would be held above the plate 13 and the descending hank 32 of fiber 25 would be compressed and moved into the slot 19, along the slot 19 and into the bore 15. The descending hank 32 of fiber 25 would be pulled downward drawing the binder 28 into the bore 15 and trapping the binder 28, because the binder 28 would not be able to pass through the bottom of the bore. When the hank 32 of fiber 25 is released from compression, it naturally tends to expand outward to a diameter which is greater than the second or lower diameter of the bore 15, and this expansion locks the binder 28 within the bore 15. To move the binder 28 from the bore 15, the hank 32 of fiber 28 is simply compressed to a smaller diameter and pressed upward, forcing the binder 28 out of the top of the bore 15. Then the binder 28 within the descending fiber 25 can be moved straight upward or can be moved outward for the slot 19.

In the preferred version of the invention, the binder 28 is a plastic wire tie 30 that has an effective diameter which is smaller than the first or upper diameter of the bore 15 but larger than the second or lower diameter of the bore 15. This means that the binder 28 can be moved down into the bore 15 but will not pass through the bore 15. The wire tie 30 is wrapped tightly around the center of the hank 32 of fiber 25 so that portions of the hank 32 extend from each side of the binder 28. The wire tie binder 28 has a prism-like locking portion which is relatively large and a tape-like wrapping portion, the first end of which is connected to the locking portion, actually passes around the hank 32 of fiber 25, and into the locking portion, where it is locked into the locking portion. The wrapping portion is typically relatively small compared to the locking portion. In practice, the binder 28 with the hank 32 of fiber 25 hanging from each side, will be moved radially inward from the outside of the plate 13 toward the bore 15. The binder 28 would be held above the plate 13 and descending hank 32 of fiber 25 would be compressed and moved into the slot 19, along the slot 19, and into the bore 13. The descending hank 32 of fiber 25 would be pulled downward, drawing the binder 28 into the bore 13 and trapping the binder 28, because the locking portion would not be able to pass through the bottom of the bore 13. Normally, the wrapping portion would be small enough to pass through the second or lower opening in the bore 13 so that the wrapping portion would hang down below the plate 13 and hold the hank 32 of fiber 25 below the plate 13. When the hank 32 of fiber 25 is released from compression, it naturally tends to expand outward to a diameter which is greater than the second or lower diameter of the bore 13, and this expansion locks the binder 28 within the bore 13. To remove the binder 28 from the bore 13, the hank 32 of fiber 25 is simply compressed to a smaller diameter and pressed upward, forcing the binder 28 out of the top of the bore 13. Then the binder 28, with the descending fiber 25, can be moved straight upward or can be moved outward from the slot 19.

In the preferred embodiment of the invention, a large number of bores 15 would be positioned around the periphery of the circular suspension plate 13. Each of the bores 15 would have a slot 19 communicating with the outside periphery 14 of the plate 13. Each out of the bores 13 would have a hank 32 of fiber 25 suspended in the manner described above, so that the suspension plate 13 would present a large number of hanks of fiber 25 of various kinds for viewing by the user.

While a few embodiments of the invention have been described, it will be understood that the invention is capable of further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. A method of separating and retaining fiber comprising:

(a) providing a plate with a plurality of bores therein, (b) forming a plurality of slots in said plate and extending from the outer edge thereof, each slot corresponding to a respective bore, (c) cutting a plurality of strands of fiber into lengths, (d) binding the fiber into a hank with a binder, and (e) inserting a hank of fiber radially into a slot and drawing the hank downward so that the binder is caught in the bore which is associated with the slot and the hank hangs down from the bore.

2. The method of claim 1 including attaching said plate to a base separated therefrom.

3. The method of claim 1 including providing rotating means for rotating the plate relative to a support surface.

* * * * *